United States Patent [19]

Comer et al.

[11] 4,230,297

[45] Oct. 28, 1980

[54] MOUNTING BRACKET FOR FLUORESCENT FIXTURES AND THE LIKE

[75] Inventors: O. Lawrence Comer; Wyndell G. Muse, both of Americus; Tommy Clure, Smithville, all of Ga.

[73] Assignee: Metalux Corporation, Americus, Ga.

[21] Appl. No.: 730,220

[22] Filed: Oct. 6, 1976

[51] Int. Cl.[2] ..... B42F 13/00

[52] U.S. Cl. ..... 248/317; 52/28

[58] Field of Search ..... 248/317, 228, 226 E, 248/72, 342, 343; 24/259 R, 259 TF, 201 S, 230 F; 52/484, 485, 489, 144, 28, 29; 240/51.11 R, 78 DR, 78 CF

[56] References Cited

U.S. PATENT DOCUMENTS

| | | | |
|---|---|---|---|
| 1,412,830 | 4/1922 | Bennington | 248/228 UX |
| 2,459,034 | 1/1949 | Kruger | 248/343 |
| 2,758,810 | 8/1956 | Good | 248/343 |
| 2,890,011 | 6/1959 | Barr | 248/228 |
| 3,556,452 | 1/1971 | Ramsey | 248/228 |
| 3,601,862 | 8/1971 | Hargadon | 248/317 X |
| 3,618,176 | 11/1971 | Barnes | 248/343 X |

FOREIGN PATENT DOCUMENTS

| | | | |
|---|---|---|---|
| 1489520 | 4/1969 | Fed. Rep. of Germany | 240/51.11 R |
| 1574669 | 7/1969 | France | 240/51.11 R |
| 818194 | 8/1959 | United Kingdom | 240/51.11 R |
| 1255024 | 11/1971 | United Kingdom | 240/51.11 R |

*Primary Examiner*—J. Franklin Foss

*Attorney, Agent, or Firm*—Richards, Shefte & Pinckney

[57] ABSTRACT

A mounting bracket comprising two cooperating elements pivotally mounted together for pivotal movement between a first open position to dispose the bracket around a support beam or the like, and a second closed position at which the mounting bracket is securely held in place on the support beam. The two cooperating elements each include an engagement wall portion for engaging the support beam and a bearing wall portion for supporting a fixture, such engagement wall portions and bearing wall portions, respectively, being separated, at the first open position of the cooperating elements, and being adjacent one another in coplanar relationship at the second closed position of the cooperating elements.

9 Claims, 8 Drawing Figures

MOUNTING BRACKET FOR FLUORESCENT FIXTURES AND THE LIKE

BACKGROUND OF THE INVENTION

In modern building structures, it is common practice to provide a dropper ceiling located beneath the structural ceiling to provide a space for locating ducts, electrical wiring and similar items. Generally, these dropped ceilings are formed by a suspended grid of inverted tees which support various types of ceiling boards, and lighting fixtures are often mounted to these inverted tees.

There are a variety of mounting brackets presently being used to mount lighting fixtures to an inverted tee, one common example being a metal clip that snaps onto the inverted tee and includes a depending threaded stud that extends through an opening provided in the lighting fixture so that a nut and washer can be threaded on the depending stud to hold the fixture in place. Examples of such mounting brackets are disclosed in U.S. Pat. No. 2,868,490, issued Jan. 13, 1959, to Price and U.S. Pat. No. 3,003,735, issued Oct. 10, 1961, to Havener. This type of mounting bracket is somewhat difficult to use because of the tolerances involved in locating the studs at a proper location with respect to the lighting fixture openings, and the installation of such mounting brackets is often time consuming because it requires threadably mounting a nut onto the stud, usually within the confines of the lighting fixture itself.

In an effort to avoid the above-described drawbacks of mounting brackets having a threaded stud, it has been proposed in U.S. Pat. No. 3,589,660, issued June 29, 1971, to Dunckel, to form a mounting bracket having clips for engaging an inverted tee, and having depending, resilient flanges for functionally engaging the side walls of a lighting fixture. While mounting brackets of this type are generally easy to install, they are restricted to use with lighting fixtures having a size corresponding to the separation of the depending flanges of the mounting bracket, and they may become disengaged from either the inverted tee or the lighting fixture during use since they rely principally upon a frictional engagement with the inverted tee and the lighting fixture.

By substantial contrast, the present invention provides a mounting bracket which does not require a threaded stud, and which can be quickly and easily mounted in place to hold the lighting fixture or the like securely in place during use.

SUMMARY OF THE INVENTION

In accordance with the present invention, a mounting bracket is provided which includes two cooperating elements formed at a pivot connection, the cooperating elements each including an engagement wall surface portion for selectively engaging the support surface of an inverted tee, I-beam or the like, and including bearing wall portions for location within a lighting fixture or the like to permit the lighting fixture to be securely supported thereby.

The cooperating elements are first positioned with the bearing wall portions inserted through a slot in the lighting fixture casing, and then pivoted to a first open position at which the engagement wall surfaces are separated to receive therebetween the flange or support surface of the inverted tee. The cooperating elements are then pivoted to a second closed position at which the engagement wall surfaces are located adjacent one another in coplanar relation to engage the flange or support surface. When the cooperating elements are moved to this second closed position, the aforesaid bearing wall portions, located within the lighting fixture casing, also move to an adjacent, coplanar position which permits the lighting fixture casing to then rest on, and be supported by, the bearing wall portions while also preventing separation or opening of the cooperating elements.

Preferably, the two cooperating elements are identical in construction, and are formed from a continuous sheet of rigid material, such as steel. In each cooperating element, the bearing wall portion and the engagement wall portion are disposed in spaced, parallel planes, and connected together by an intermediate wall portion extending therebetween with appropriate bends to permit the two cooperating elements to be pivotally joined at one such bend with a portion of the intermediate wall portions of each cooperating element arranged for abutment when the cooperating elements are at their second closed position to thereby assist in maintaining the cooperating elements at this second closed position.

The intermediate or extending wall portions preferably include a portion thereof which is struck out to project outwardly under the natural bias of the material from which it is formed whereby the lighting fixture casing can pass over the projecting portion by moving it against its bias during mounting of the mounting bracket in the lighting fixture casing, and the lighting fixture casing will thereafter be prevented from passing along the extending wall portion after the mounting bracket is located in place.

Finally, the bearing wall portions may include upstanding portions or ridges adjacent the extending ends thereof to concentrate the load of the lighting fixture casing at such extending ends to thereby assist in holding the cooperating elements at their second closed position when the mounting bracket is in place.

DESCRIPTION OF THE PREFERRED EMBODIMENT

Figure 1:
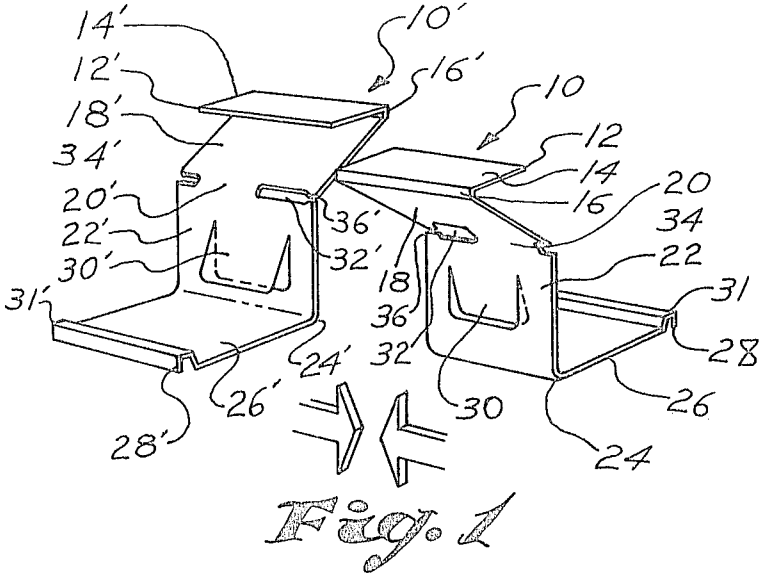
FIG. 1 is an exploded view of the mounting bracket of the present invention illustrating the cooperating elements at a separated disposition.
Figure 2:
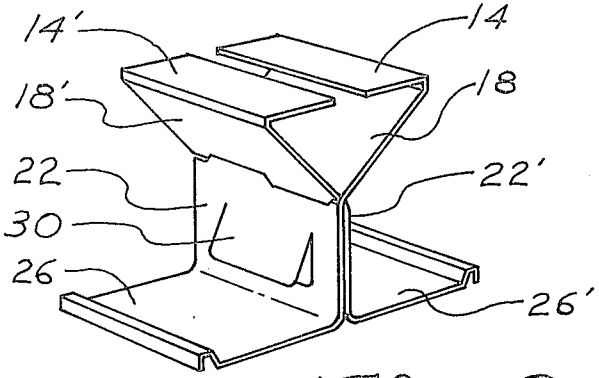
FIG. 2 is a perspective view of the mounting bracket illustrating the cooperating elements at a joined disposition.

Looking now in greater detail at the accompanying drawings, FIGS. 1 and 2 illustrate a mounting bracket embodying the present invention, such mounting bracket comprising two identical cooperating elements 10, 10'. Since the cooperating elements 10, 10' are identical, a description of one will serve to understand both, it being noted that corresponding parts of the cooperating elements 10, 10' have the same reference numerals with one including a prime symbol.

The cooperating element 10 may be formed from a continuous sheet of rigid material, such as sheet metal, and includes a first edge 12 having a flat engagement wall portion 14 extending therefrom to a first bend 16. A connecting wall portion 18 extends from the first bend 16 in angular relationship therewith to a second bend 20, from which an extension wall portion 22 extends to a third bend 24. Extending from the third bend 24 is a flat bearing wall portion 26 terminating at a second edge 28. It will be noted that the engagement wall portion 14 and the bearing wall portion 26 are disposed in spaced, parallel planes, and the extension wall portion 22 lies in a plane disposed perpendicularly with respect to both the engagment wall portion 14 and the bearing wall portion 26.

For purposes to be described in greater detail presently, the extension wall portion 22 includes a projecting portion 30 which is preferably formed by simply forming a U-shaped cut that is then struck out of the extension wall portion 22 whereby it will normally remain at a projecting disposition under the natural bias imposed by the material at the bend of the projecting portion 30. Additionally, the bearing wall portion 26 is formed with a generally U-shaped bend therein to provide an upwardly projecting or raised surface portion 31 adjacent the second edge 28.

The cooperating element 10 also includes a first slot 32 extending along the second bend 20 from one side edge thereof to a point approximately midway thereacross, and a second smaller slot 34 extending along the second bend 20 from the other side edge thereof for a short distance. The first slot 32 includes a pair of projecting tabs 36 at the open end thereof. To form the mounting bracket of the present invention, the two cooperating elements 10, 10' are connected together, as illustrated in FIG. 2, with the tabs 36, 36' of the longer slots 32, 32' engaging the shorter slots 34, 34', respectively, whereby the cooperating elements 10, 10' are loosely held for pivotal movement with respect to another about the second bends 20, 20' thereof.

FIGS. 3–8 illustrate the manner in which the mounting bracket of the present invention is used to mount a lighting fixture 38 to an inverted tee 70, it being expressly understood, however, that the mounting bracket of the present invention is not limited in application to mounting the particular lighting fixture 38 to the particular inverted tee 40 which are simply illustrative of such applications.

Figure 3:
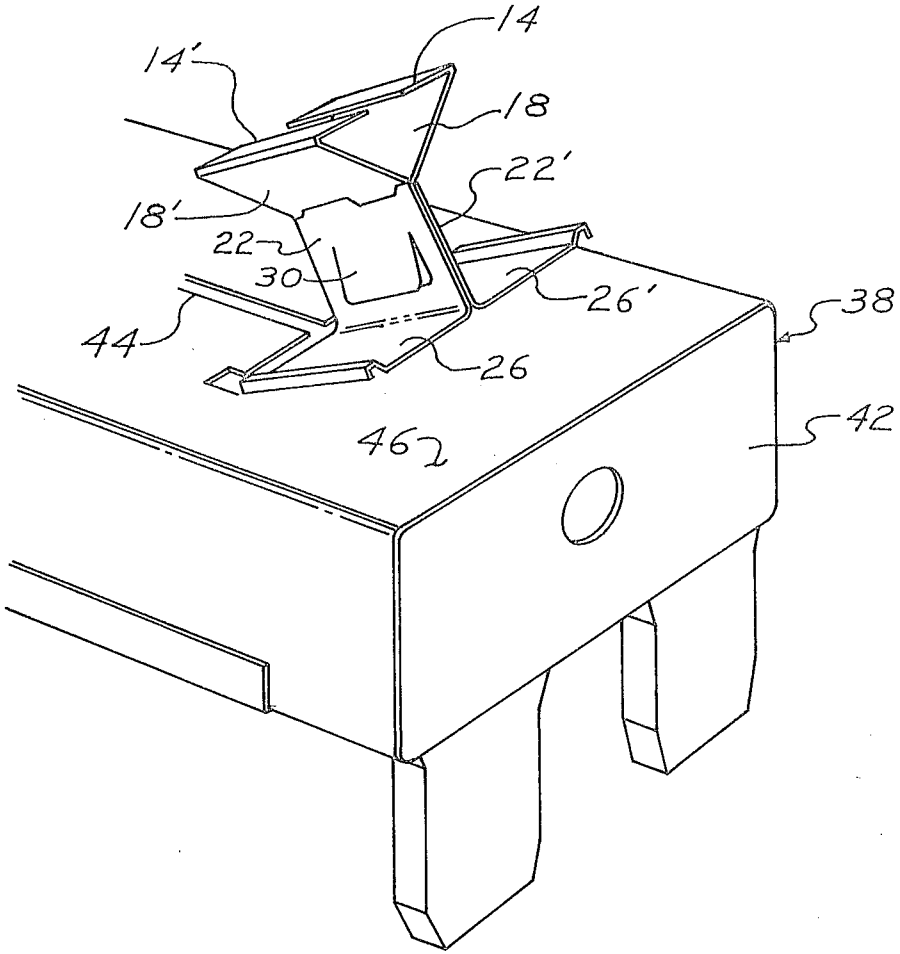
FIG. 3 is a perspective view showing the mounting bracket being inserted in the slot of a lighting fixture casing.
Figure 4:
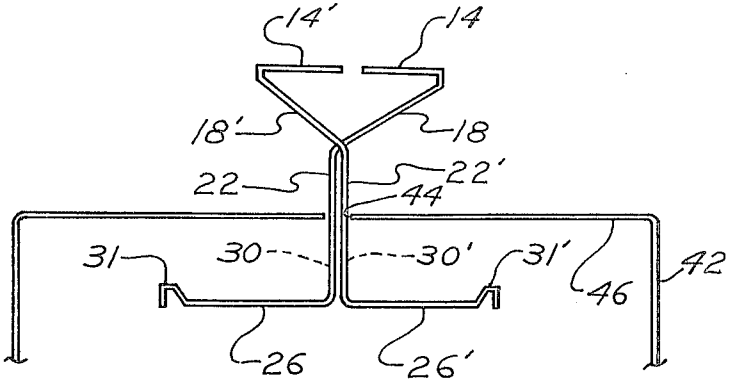
FIG. 4 is an elevation view illustrating the mounting bracket located partially within the lighting fixture casing.

As best seen in FIG. 3, the casing 42 of the lighting fixture 38 is formed with T-shaped slot 44 to receive the mounting bracket, which is at its closed position with the respective extension wall portions 22, 22' in abutment with one another and in adjacent parallel planes. After the mounting bracket is inserted through the slot 44, the bearing wall portions 26, 26' will be disposed interiorly of the lighting fixture casing 42 just beneath the top wall 46 thereof, with the extension wall portions 22, 22' disposed within the slot 44. As best seen in FIG. 4, the mounting bracket, which is still at its closed position, is moved downwardly into the lighting fixture casing by manually pressing the struck out projections 30, 30' against their natural bias so that they will be flush with the extension wall portions 22, 22', and the extension wall portions 22, 22' will then slide downwardly within the slot 44.

Figure 6:
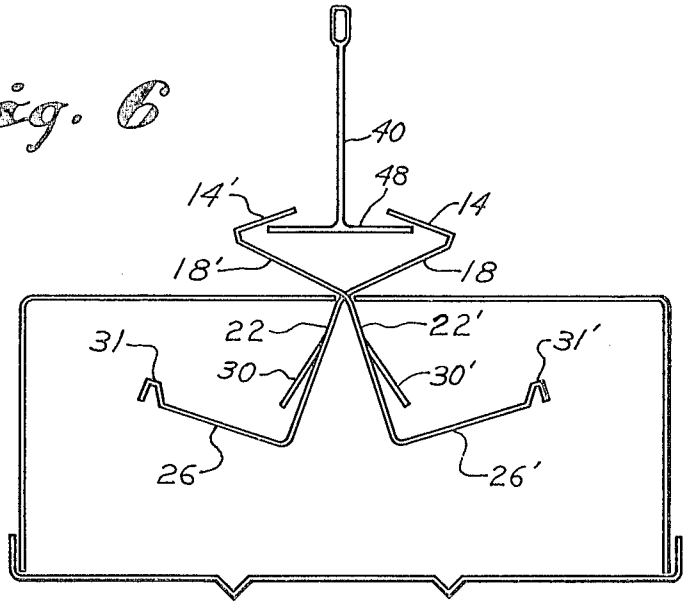
FIGS. 6 and 7 are elevation views illustrating the mounting bracket at its open and closed positions, respectively, during mounting thereof on the inverted tee; and, FIG. 8 is an elevation view illustrating the mounting bracket at its final, mounted disposition.
Figure 5:
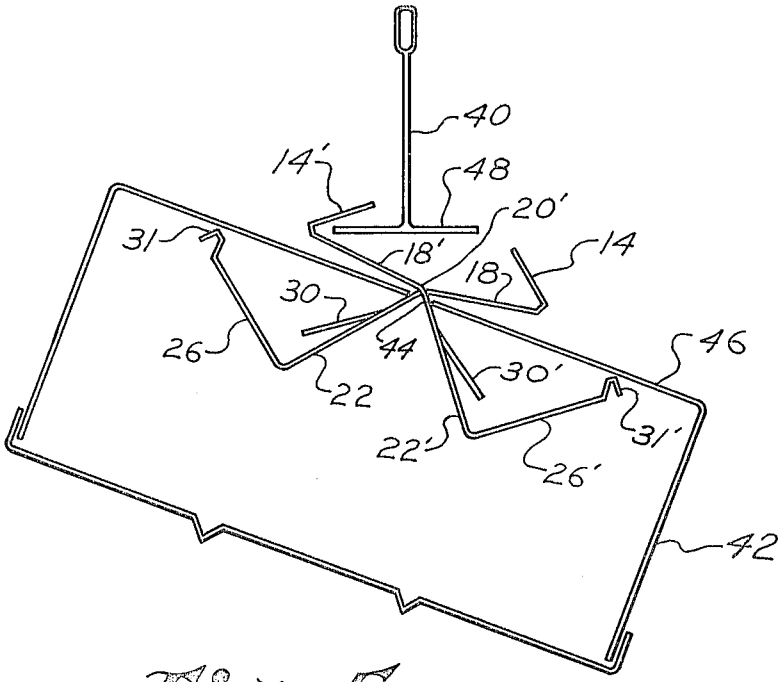
FIG. 5 is an elevation view illustrating the mounting bracket located within the lighting fixture casing and disposed at its open position for receiving the flange of an inverted tee.

When the bearing wall portions 26, 26' are located at their lowest position beneath the lighting fixture casing top wall 46, the mounting bracket is then pivoted about the second bends 20, 20' from its aforesaid closed position to an open position, as shown in FIG. 5, at which the engagement wall portions 14, 14' are substantially separated from one another, it being noted that the vertical extent of the extension wall portions 22, 22' beneath the fixture wall 46 permits the bearing wall portions 26, 26' to be separated within the lighting fixture casing 42 without contacting the top wall 46 of the casing 42. At this open position of the mounting bracket, it will be apparent that the supporting flange 48 of the inverted tee 40 can be readily received between the separated bearing wall portions 26, 26' as shown in FIG. 5, and both bearing wall portions 26, 26' can then be arranged above the supporting flange 48 as seen in FIG. 6.

Figure 7:
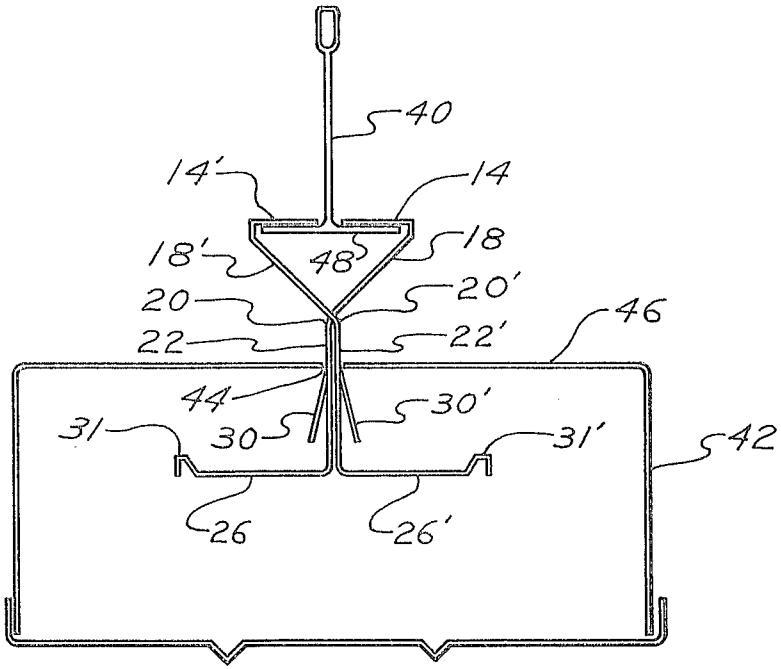

The mounting bracket is then pivoted to its fully closed position as shown in FIG. 7 so that the bearing wall portions 26, 26' are moved to a position adjacent one another in coplanar relation, resting on the supporting flange 48. The lighting fixture casing 42 is then moved downwardly, with the slot 44 thereof pressing the projecting portions 30, 30' inwardly, until the top wall 46 of the lighting fixture casing rests upon the upwardly extending ridge 31 in the bearing wall portions 26 as illustrated in FIG. 8, it being noted that when the slot 44 passes over the ends of the inwardly pressed projections 30, 30', they will immediately return to their outwardly projecting position under the urging of their aforementioned natural bias.

Figure 8:
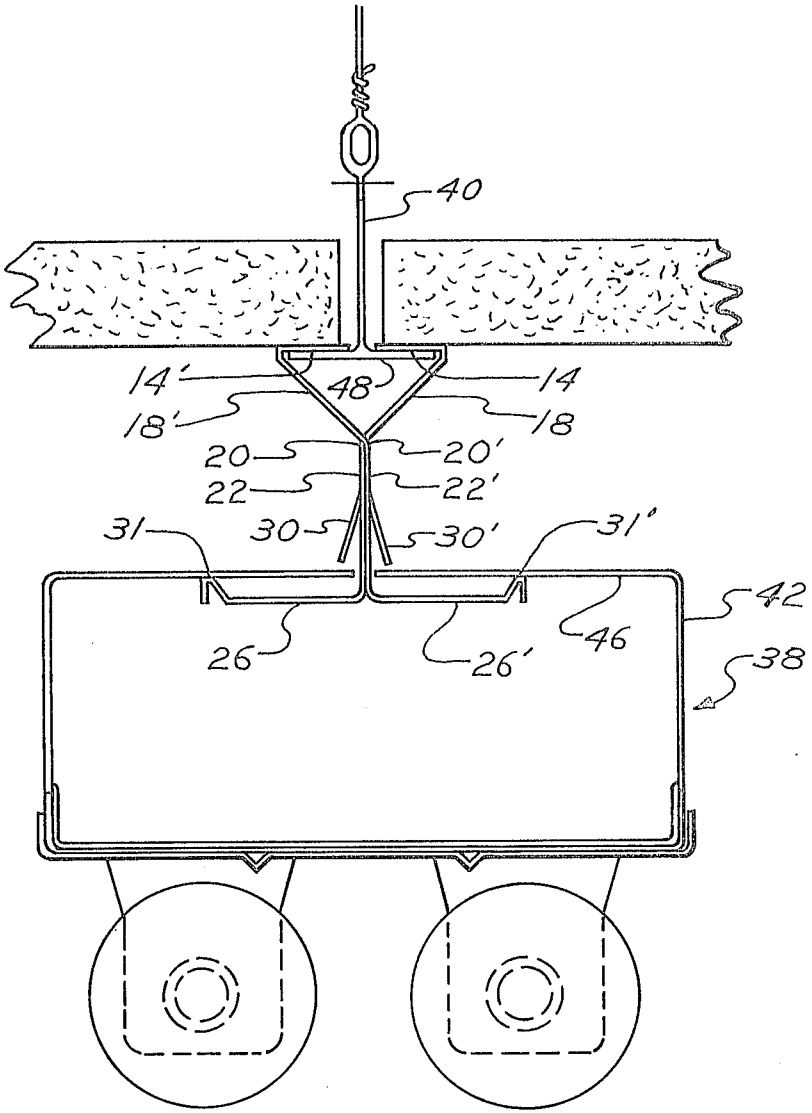

At the fully mounted position shown in FIG. 8, the weight of the lighting fixture 38 is imposed upon the raised bends 31, 31' at the outermost ends of the bearing wall portions 26, 26' so that the cooperating members 10, 10' are urged about the pivoted second bends 20, 20' toward their closed position whereby the engagement wall portions 14, 14' will be constantly urged toward one another so as to securely and permanently engage the supporting flange 48 of the inverted tee. Moreover, if for any reason the lighting fixture casing 38 had any tendency to be lifted off of the raised portions 31, 31', the top wall 46 of the casing 38 would immediately come into contact with the outwardly projecting portions 30, 30' to prevent further upward movement of the casing 38. Accordingly, the mounting bracket is always held at its FIG. 8 position, and the narrow confines of the casing slot 44 will always maintain the extension wall portions 22, 22' adjacent one another to insure thereby that the engagement wall portions 14, 14' will remain adjacent one another in a coplanar relationship and provide a secure, steady support for the lighting fixture 38. On the other hand, if it is necessary to remove the lighting fixture 38 from its supported position, the projecting portion 30, 30' can be manually pressed to their flush position with respect to the extension wall portions 22, 22', whereupon the lighting fixture casing 38 can be moved upwardly to the position shown in FIG. 5 and the cooperating elements 10, 10' can then be pivoted to their open position to release the supporting flange 48 from between the engagement wall portions 14, 14'.

It is believed apparent from the above that the disclosed embodiment of the present invention provides a mounting bracket which can be quickly and easily installed to support a lighting fixture or the like without requiring any tools or any specialized training, and which, once installed, is securely fixed in place so that it cannot accidentally or inadvertently become disengaged from either the lighting fixture or the inverted tee. However, when desired, the mounting bracket can be deliberately disengaged, again without requiring any tools or specialized training.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. A bracket device for hanging a lighting fixture or the like form a support beam having a support surface, said bracket device including:

(a) a pair of engagement members each including a generally flat engagement surface connected together by pivot means for movement between a first open position at which said engagement surfaces are substantially separated from one another and a second closed position at which said engagement surfaces are disposed adjacent one another and in a coplanar relationship;

(b) a pair of extending members connected, respectively, to said engagement members to extend oppositely therefrom with respect to said pivot means;

(c) a pair of bearing members connected respectively to said extending members, each said bearing member including a generally flat bearing surface, with said bearing members being arranged to dispose said flat bearing surfaces in a coplanar relationship parallel to the plane of said engagement member at said second closed position thereof.

2. A bracket device as defined in claim 1 and further characterized in that said extending members comprise flat extension surfaces arranged to abut one another when said engagement members are at said second closed position thereof.

3. A bracket device as defined in claim 2 and further characterized in that at least one of said extending members includes a projecting portion normally biased to a holding position extending outwardly from said extension surface, said projecting portion being selectively movable against such bias to a position coplanar with said extension surface.

4. A bracket device as defined in claim 1 and further characterized in that each of said bearing members includes a raised surface portion extending upwardly from said flat bearing member at the end thereof opposite from its connection to said extending member.

5. A bracket device for hanging a lighting fixture or the like from a support beam having a flat support surface, said bracket device including:

(a) a pair of cooperating elements, each said cooperating element being formed from a continuous sheet of rigid material, and each said cooperating element including (i) a flat engagement wall portion extending from a first edge to a first bend;

(ii) a connecting wall portion extending from said first bend to a second bend, said connecting wall portion being disposed in angular relationship to said engagement wall portion;

(iii) an extension wall portion extending from said second bend to a third bend, said extension wall portion being in a plane disposed perpendicularly with respect to the plane of said engagement wall portion; and (iv) a generally flat bearing wall portion extending from said third bend to a second edge, said bearing wall portion extending perpendicularly with respect to said extension wall portion and being in a plane disposed parallel to the plane of said engagement wall portion;

(b) said pair of cooperating elements being connected to one another by pivot means and being arranged for pivotal movement between a first open position at which said engagement surfaces and said extension wall portions are spaced from one another, and a second closed position at which said engagement surfaces are disposed in an adjacent coplanar relationship and at which said extension wall portions are disposed in parallel planes and abut one another.

6. A bracket device as defined in claim 5 and further characterized in that said pivot means includes slots formed in each of said cooperating elements at said second bends thereof which permit said cooperating elements to engage one another in a pivotal relationship.

7. A bracket device as defined in claim 5 and further characterized in that said bearing wall portion of each said cooperating elements includes a raised surface portion adjacent said second edges of said bearing wall portion.

8. A bracket device as defined in claim 5 and further characterized in that said extension wall portion of at least one of said cooperating elements includes a projecting portion normally biased to a holding position extending outwardly from said extension wall portion, said projecting portion being selectively movable against said bias to a position coplanar with said extension wall portion.

9. A bracket device for hanging a lighting fixture or the like from a support beam having a flat support surface, said bracket device including:

(a) a pair of cooperating elements, each said cooperating element being formed from a continuous sheet of rigid material, and each said cooperating element including (i) a flat engagement wall portion extending from a first edge to a first bend;

(ii) a connecting wall portion extending from said first bend to a second bend, said connecting wall portion being disposed in angular relationship to said engagement wall portion;

(iii) an extension wall portion extending from said second bend to a third bend, said extension wall portion being in a plane disposed perpendicularly with respect to the plane of said engagement wall portion, said extension wall portion of at least one of said cooperating elements including a projecting portion normally biased to a holding position extending outwardly from said extension wall portion, said projecting portion being selectively movable against said bias to a position coplanar with said extension wall portion; and (iv) a generally flat bearing wall portion extending from said third bend to a second edge, said bearing wall portion extending perpendicularly with respect to said extension wall portion and being in a plane disposed parallel to the plane of said engagement wall portion, and said bearing wall portion including a raised surface portion adjacent said second edge thereof;

(b) said pair of cooperating elements being connected to one another by corresponding slots formed in each of said cooperating elements at said second bends thereof and being arranged for pivotal movement between a first open position at which said engagement surfaces and said extension wall portions are spaced from one another, and a second closed position at which said engagement surfaces are disposed in an adjacent coplanar relationship and at which said extension wall portions are disposed in parallel planes and abut one another.

* * * * *